United States Patent [19]

Runge

[11] 4,265,557

[45] May 5, 1981

[54] KEYBOARD APPARATUS

[76] Inventor: J. Marvin Runge, 20547 Evergreen Rd., Detroit, Mich. 48219

[21] Appl. No.: 5,096

[22] Filed: Jan. 22, 1979

[51] Int. Cl.[3] ..... B41J 5/08

[52] U.S. Cl. ..... 400/479; 400/473; 400/492; 400/489; 340/365 R

[58] Field of Search ..... 400/143, 472, 473, 474, 400/477, 478, 479, 479.1, 479.2, 482, 483, 484, 485, 486, 488, 489, 490, 491, 492; 340/365 R, 365 VL, 365 S, 365 C, 365 L, 365 P, 365 A, 365 E

[56] References Cited

U.S. PATENT DOCUMENTS

| | | | |
|---|---|---|---|
| 423,622 | 3/1890 | Murray | 400/143 |
| 714,299 | 11/1902 | Greule | 400/491 X |
| 919,432 | 4/1909 | Horstmann | 400/474 X |
| 1,447,280 | 3/1923 | Corcoran | 400/492 |
| 1,828,939 | 10/1931 | Ostrey | 400/492 |
| 3,633,724 | 1/1972 | Samuel | 400/485 |
| 3,705,424 | 12/1972 | Harvey | 400/479 X |
| 3,945,482 | 3/1976 | Einbinder | 400/484 X |
| 3,950,634 | 4/1976 | Speiser | 340/365 R X |
| 4,029,915 | 6/1977 | Ojima | 400/485 X |
| 4,065,650 | 12/1977 | Lou | 340/365 R |

FOREIGN PATENT DOCUMENTS 2017063 10/1970 Fed. Rep. of Germany ..... 4 00/489

OTHER PUBLICATIONS

Xerox Disclosure Bulletin, "Semi-Captive Keyboard", Kowalski, vol. 1, No. 2, Feb. 1976, p. 85.

*Primary Examiner*—Ernest T. Wright, Jr.
*Attorney, Agent, or Firm*—Robert B. Watkins

[57] ABSTRACT

A keyboard apparatus construction (FIG. 1) is provided which clusters the keys operated by each finger closely about the finger in its "home row" position on the home row of the generally accepted keyboard configuration. The upper or "number" row is operated by a key that rests above the operator's fingers (FIG. 2) which can be operated by raising the finger. In one embodiment the keyboard is mounted in a frame that fits over and is auxiliary to the typewriter (FIG. 5).

10 Claims, 6 Drawing Figures

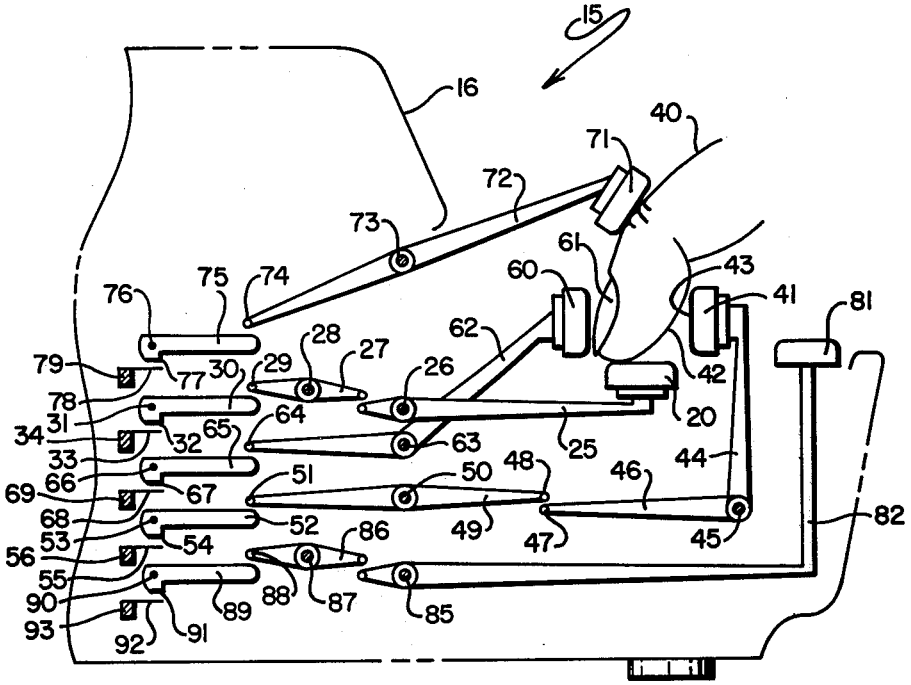
FIG. 2
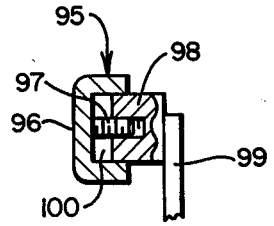
FIG. 4
FIG. 3
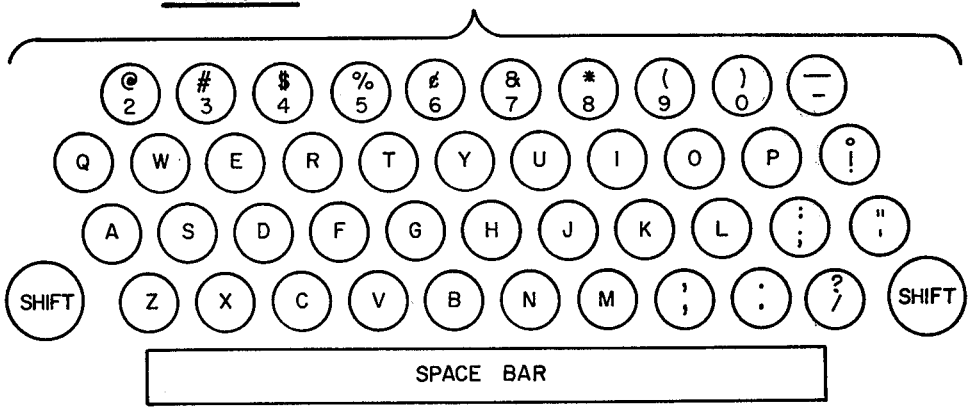

KEYBOARD APPARATUS

SUMMARY OF THE INVENTION

This invention relates to keyboard apparatus and to the arrangement of keys, and more particularly to a novel typewriter key and keyboard construction for use with conventional typewriters.

The invention herein disclosed is a keyboard arrangement and apparatus where the keys are closely positioned to the home keys and are configured to be moved by only slight movement of the typist's fingers from the home key position.

In the use of this invention, the typist makes the usual normal stroking motion toward those keys above and below the home row, and the intended key has been positioned to be met after the typist's finger has traveled only a little way.

Those keys positioned in the next row above and below the home row, i.e., the first and third rows, are tilted upward to the near vertical position, and are just forward and to the rear respectively, of the keys of the home row. The keys of the number row, i.e., the fourth row, are positioned forward of the keys of the third row and may be tilted even further toward the normal finger rest position of the typist's finger.

Because the first finger of each hand has the normal function of operating two rows, i.e., the home row and the one next toward the center, two vertical rows of keys, according to this invention, are provided for the operation of these index fingers.

The primary object of the invention is to provide a typewriter keyboard, having key members that are operable by the normal stroking methods of a typist's fingers, but by reducing the amount of moving required, thereby giving the result and advantage of higher typing speeds as well as reducing the number of errors.

Another object of the invention is to provide a typewriter keyboard which is adaptable for use with standard typewriter configurations without changing any of the operational components thereof.

A still further object of the invention is to provide a typewriter keyboard, the operation of which is easily taught to a typist using basic and established methods with little variation therefrom.

The foregoing and other advantages of the invention will become apparent from the following disclosure in which a preferred embodiment of the invention is described in detail and illustrated in the accompanying drawing. It is contemplated that variations in structural features and arrangement of parts may appear to the person skilled in the art, without departing from the scope or sacrificing any of the advantages of the invention.

Standard typewriter keyboards consist of 40 or more keys arranged in four rows on the face of the typewriter front panel. Operation of such standard typewriters usually is taught by instructing the typist to position the fingers of each hand above certain of the keys of the second row from the bottom of the keyboard, with each of the eight fingers of the typist's hands being positioned above one of the eight keys. The typist reduces to memory the positions of each respective key on the standard keyboard, and, through practice and development of typing skills, is able to move his or her fingers to the desired keys in any of the four rows, always returning his or her fingers to "home" position on the second row, after stroking the desired key.

Standard typewriter keyboards require that each finger of the typist's hands be responsible for the depression of four to eight keys located in each of the four rows. The distance a particular finger must move to hit the desired key from the home position is in some cases substantial. Even if the typist is highly skilled, misprints, jamming and other errors occur. It is not uncommon for even the most skilled typist to have to look away from the copy which is being duplicated on the typewriter and make sure the finger position is proper before proceeding in the typing operation.

Of significance also is the time involved in reaching for keys other than the home position key. For each stroke other than on a home key, the typist must reach, stroke, and return. For distant keys, such as the fourth or top row, sometimes called "number" row, the distance is two rows, and for some typists this requires that the hand move up off of the home row.

Despite the drawbacks and problems associated with standard typewriter keyboards, such keyboards are in wide and universal use. This is because prior to this invention any substantial change in the key arrangement would have required completely revising teaching methods, both for novice and experienced typists. The standard keyboard makes it possible for typists to readily change typewriters and continue without a complete new learning experience.

The problem of typewriter keyboard arrangements have been recognized in the past, and various patents have been directed to improving these arrangements. U.S. Pat. Nos. 423,622, 919,432, 3,633,724, 3,705,424, and 3,945,482 are representative of the approaches taken by other inventors in this area. German Pat. No. 2,017,063 is also representative.

DESCRIPTION OF THE DRAWING

FIG. 2 is an elevational cross sectional view of a keyboard mechanism of this invention taken along the line 2—2 of FIG. 1.

FIG. 3 is a diagramatic plan view of a typical typewriter keyboard commonly in use.

FIG. 4 is an elevational sectional view taken along the line 4—4 of FIG. 1.

DETAILED DESCRIPTION OF THE INVENTION

Figure 1:
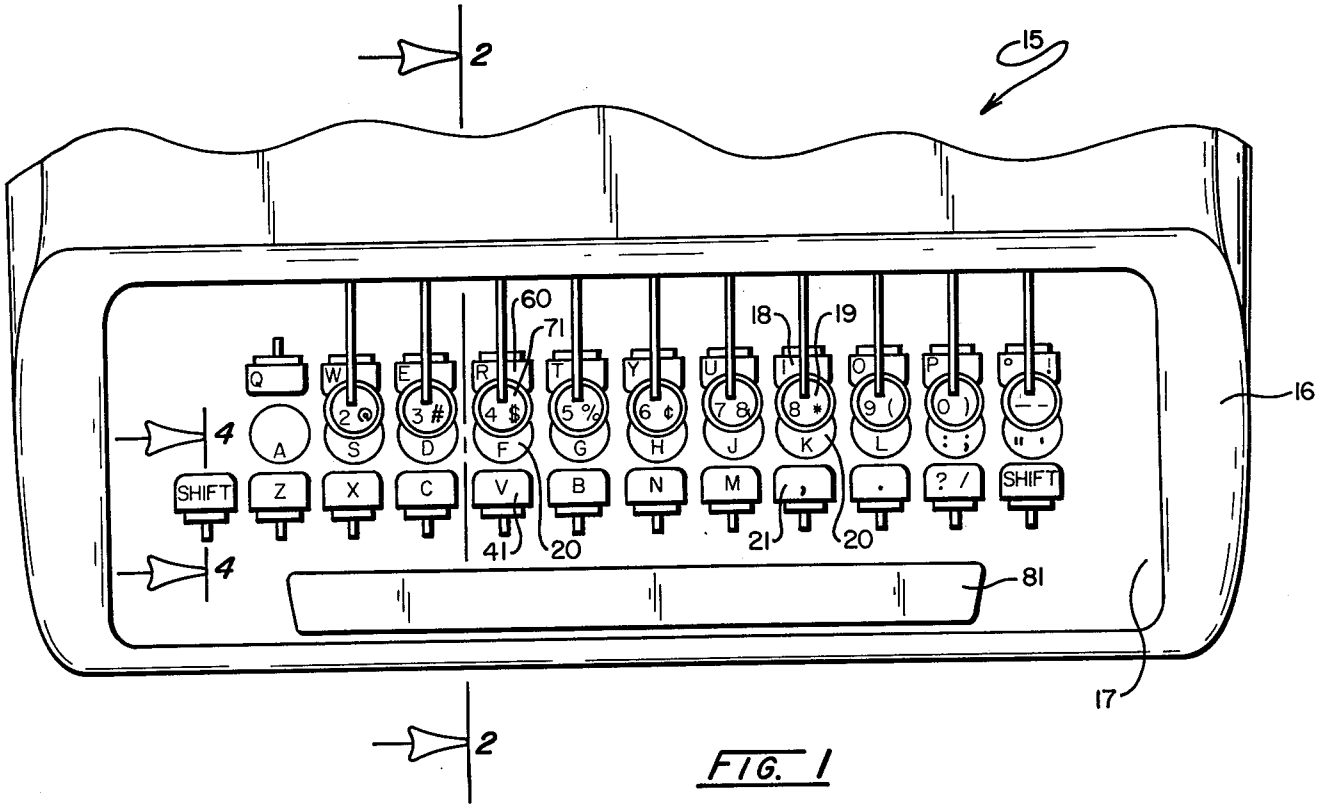
FIG. 1 is a plan view of a portion of a typewriter having the keyboard of this invention.

The means and apparatus of this invention is illustrated in one embodiment in FIG. 1. A typewriter 15 having a frame 16 is formed with an opening 17. Upwardly projecting through the opening 17 are a plurality of keys 18, 19, 20 and 21, which are generally uniformly arranged in lateral rows across the opening 17 of the frame 16.

As is well known in typical typewriter construction, each key operates through an internal mechanical or electrical means, not shown, to print a letter of the alphabet or other symbolic character upon a substrate such as paper. The key is actuated by application, or "striking," of a finger against it, causing it to move. The movement of the key when it is struck is the actuating motion causing the "typing" to take place.

The keyboard arrangement on typewriters has become standardized generally as shown in FIG. 3, for the United States of America. All the letters of the alphabet are represented on the keyboard individually in the first 3 rows from the bottom. The first row contains keys for z, x, c, v, b, n, m; the second row contains keys for a, s, d, f, g, h, j, k, l; and the third row contains keys for letters q, w, e, r, t, y, u, i, o, p. The fourth row, above the third row, contains the numerals and various characters often used in typing written material.

Those keys in the fourth row, as well as extra keys at the right hand end of the first, second and third rows, are capable of printing either one or the other of the characters controlled thereby. This is done by means of shift keys at the right and left-hand extreme positions of the first row. Usually, those characters shown at the top of the key will be typed when the shift key is depressed simultaneously, and those shown at the bottom of the key will be typed when the shift key is not pressed.

The space bar extends along the bottom of the keyboard and may be struck from any position along its length to advance the typing one space. On some electric typewriters, the space bar may be held down for repeated continuous spacing until the space bar is released.

For purposes of description of this invention, the above described key board will be termed "Standard American." However, in certain circumstances, variations of the above Standard American keyboard will be found on typewriters and other keyboard data terminals in United States, as well as typing and keyboard equipment that is manufactured for an intended use elsewhere.

The Standard American keyboard is firmly and traditionally entrenched in all phases of the American typing system. It has been taught in typing schools as part of the "touch" system since the earliest days of typewriter equipment.

In more recent years, studies of the English language have revealed that letters are inconveniently placed on the Standard American keyboard relative to the amount of usage of each letter of the more customarily used words of the English language. Therefore it has been suggested that typewriter keyboards could be rearranged so that those fingers on the home row would type the home row keys more often, and would not reach for first row, third row and fourth row keys as frequently. However, apparently the Standard American keyboard is so firmly entrenched that the market has not developed for these other keyboards and the Standard American keyboard remains the one primarily available in the marketplace at this time.

In the usual "touch" system of typewriting, using the Standard American keyboard as shown in FIG. 3, four fingers of the left hand are placed above the keys for the letters f, d, s, and a of the second row. The index finger is placed over, or in light contact, with the key for f (the f key). The second finger is placed on the d key, the third finger is placed on the s key and the fourth or "little" finger is placed on the a key.

In a like manner, fingers of the right hand are placed on the j, k, l, and semicolon keys with the first finger on the j key, etc. These fingers are termed to be on the "home row" keys.

In learning to type, the typist learns to type the remaining keys of the keyboard by moving the fingers from the home row position to the other keys of the keyboard and striking the other keys. During the learning process, the typist's fingers return to home row position after striking each other key. Actually in practice, after a typist develops skill for rapid typing, a finger may seldom return to the home row key position after each stroke, as long as one of the fingers is on a home row key as a reference point, so that the typist can maintain by memory from the reference point all of the fingers in proper positions to strike any one of the keys.

It will be apparent from the above that typing speed is a function to some degree of the rapidity of the typist in reaching for keys other than the keys of home row; and of the rapidity in striking those keys and returning to home row position. The letters of the alphabet are one row spacing away, either up or down. However, the numerals are two spaces above and require approximately double the reach when striking a key on the fourth row.

In addition to the time required for reaching and striking keys other than home row keys, it will be apparent that more effort and energy is required in striking keys other than home row keys and there is more possibility for error.

The thumbs of each hand are positioned slightly above the space bar and are used to press down the space bar when a space is required.

Whenever it is necessary to press the shift key to obtain one of the secondary characters obtainable with a certain key, the little finger of either the right or the left hand may be used to strike a shift key, although this requires an additional reach.

This invention relates particularly to the keyboard apparatus.

As shown in FIG. 2, a key 20 having a substantially horizontal contact surface is supported by an arm 25, which is rotatably journaled on a shaft 26 to press against a lever 27. The lever 27 is journaled on a shaft 28 to press at one end 29 against a switch arm 30. Switch arm 30 is pivotally supported on a shaft 31 having a contact surface 32 adjacent to an electrical contract plate 33 which is attached to a bus 34.

As also seen a FIG. 2, a finger 40 is positioned slightly above or in contact with a home row key 20. A first row key 41 is positioned substantially vertical at the bottom tip 42 of the finger 40 with a contact surface 43 in touching or near touching position. Key 41 is attached to a lever 44 which is rotatably journaled on a shaft 45. Lever 44 has an arm 46 having a contact end 47 in position to press upon a pressure point 48 of a lever 49. Lever 49 is journaled on a shaft 50 to press at one end 51 against a switch arm 52 that is pivotally supported on a shaft 53. Switch arm 52 has a contact surface 54 adjacent to an electrical contact plate 55 which is attached to a bus 56.

A third row key 60 is positioned in relatively vertical position close to or touching the upper face or fingernail 60, of the finger 40. Key 60 is attached to a lever 62 which is rotatably journaled on a shaft 63 to press at one end 64 against a switch arm 65 that is pivotally supported on a shaft 66. Switch arm 65 has a contact surface 67 adjacent to an electrical contact plate 68 which is attached to a bus 69.

A fourth row key 71 is positioned above the finger 40 adjacent to or slightly touching the upper surface thereof. Key 71 is disposed at an angle relative to the contact surface of second row key 20, and is attached to a lever 72 that is journaled on a shaft 73 to press at one end 74 against a switch arm 75 that is pivotally supported on a shaft 76. Switch arm 75 has a contact surface 77 adjacent to an electrical contact plate 78 which is attached to a bus 79.

Space bar 81 is supported in the usual position between the typist's thumbs, adjacent to and parallel to the first row of keys. Space bar 81 is attached to a lever 82, that is rotatively supported on shaft 85 to press upon a lever 86 at their adjacent ends. Lever 86 is journaled on a shaft 87 to press at one end 88 against the switch arm 89. Switch arm 89 is pivotally supported on a shaft 90 having a contact surface 91 adjacent to an electrical contact plate, 92 which is attached to a bus 93.

The mechanisms shown in FIG. 2 for key operation with the bus bars 79, 34, 69, 56 and 93 are intended to represent only a tyupical means to initiate the force from the finger 40 to the print making type of the typewriter. Many other types of mechanisms are well known in the art. It is also common typewriter construction that contact on the keys will cause an electrical assist to a mechanical means for printing the letter corresponding to the key.

As most clearly seen in FIG. 4, a typical key 95 is formed with a contact surface 96 at one side. At the opposite side a threaded stud 97 is formed for engagement in a threaded nut 98 that is attached to a lever arm 99. Threaded nut 98 is annular in form to slide in an annular groove 100 of the key 95.

Through the apparatus just described means is provided to adjust the distance between the contact surface 96 and the lever 99, as well as to adjust the distance between the contact surface 96 of a key and a typist's finger 40 on the keyboard.

Other adjustment means, such as shims or key caps, could be provided to vary the spacing and adjust the distance from fingers to key surfaces.

As shown in FIGS. 1, 2, and 4, the typist places a finger 40 in normal position on or just above a home row key 20 and between the first and third row keys 41 and 60, as well as just beneath the fourth row keys 71. It will be seen that the keys 20, 41, 60, 71 are close to the typist's fingers 40 so that any one of the keys 20, 41, 60, 71 may be actuated by slight movement of the finger 40.

For example, downward movement of the finger 40 will actuate the home row key 20, lateral movement, either forward or backward will operate first and third row keys 41 and 60, respectively, and slight upward movement will operate the fourth row keys 71.

The adjustment means shown in FIG. 4 provides for adjusting the proximity of the keys to the typist's fingers, when the fingers are in the home row position.

The general configuration of the keyboard arrangement provides that time and effort necessary to reach for keys other than home row keys is drastically reduced. This provides more rapid and more accurate typing with less effort on the part of the typist.

The advantages of more accurate and rapid typing are provided without the rearrangement of the positions on keyboard. The Standard American keyboard position arrangement is used without any relearning or changes in the typing system as it is taught and used in the United States today.

When typists are being introduced to a keyboard of this invention, the keys 95 are adjusted with the contact surface 96 to be as close as possible to the levers 99 to provide maximum leeway in striking the key 95 and causing the type to be actuated. This permits a slower reaction in the learning process. After the typist has become accustomed to this keyboard, keys 95 may be adjusted closer to the typist's fingers 40, so that typing speed is further increased as skills are increased.

Figure 5:
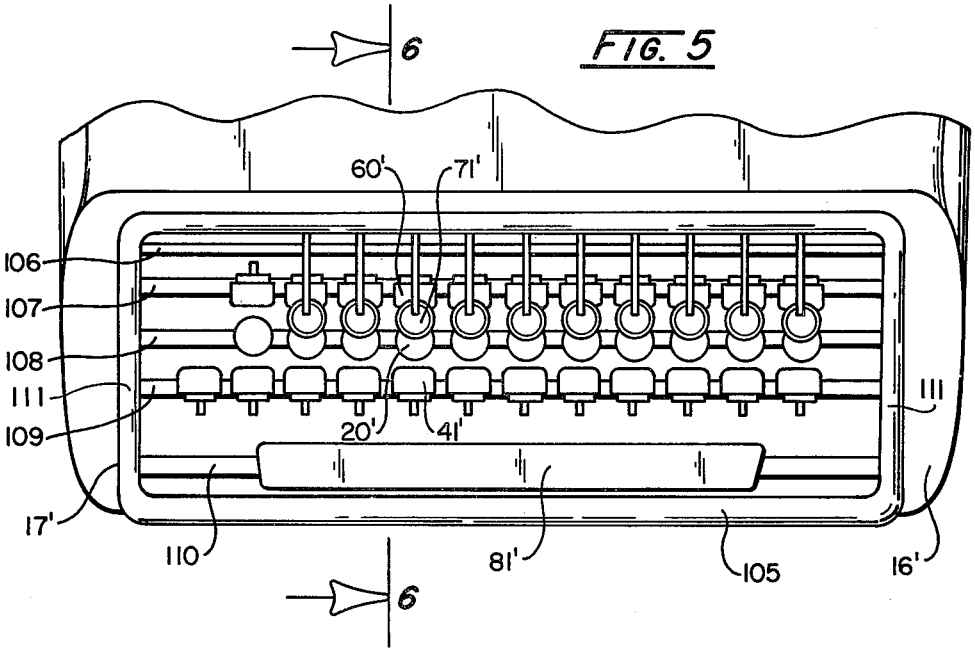
FIG. 5 is plan view of another embodiment of the keyboard of this invention.
Figure 6:
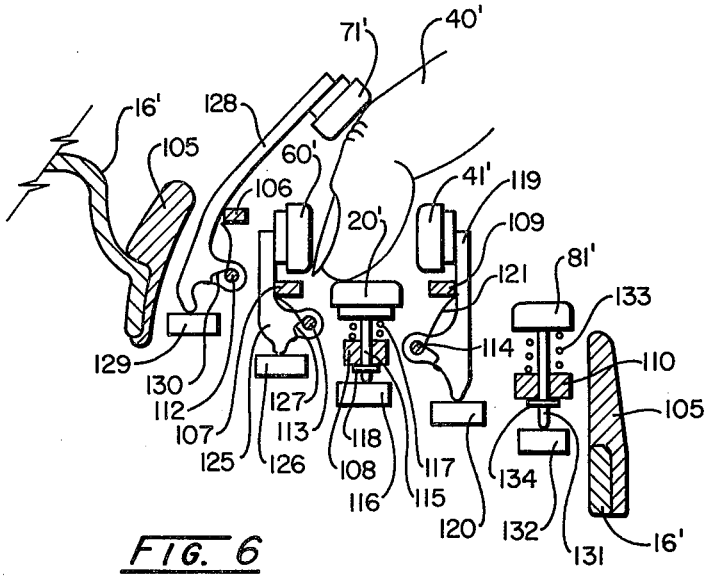
FIG. 6 is an elevational cross sectional view of the embodiment of this invention shown in FIG. 5 taken along the line 6—6 of FIG. 5.

FIGS. 5 and 6 show another embodiment of this invention wherein the keyboard apparatus is supported in a separate portable detachable frame 105 which is adapted to circumvent and fit over and into the opening 17' in the typewriter frame 16'.

Attachment frame 105 supports longitudinal frame members 106, 107, 108, 109 and 110 which are formed integral with or attached by suitable means to side pieces 111. Also supported by any well known means, in side pieces 111 are longitudinal shaft members 112, 113 and 114. Second row key 20', first row key 41', third row key 60' and fourth row key 71', are disposed within the opening of frame 105 to receive therebetween a finger 40' in the same manner as that described for the previous embodiment.

Space bar 81' is positioned appropriately to receive thumb pressure from the typist when the typist's fingers 40' are placed upon second or "home" row keys 20'.

Second row keys 20' are provided with a shaft 115, passing through frame member 108 to contact and press upon the second row keys 116 of the typewriter which are supported by frame 16'. Keys 20' are biased in their normal upward position by springs 117 or other means and limited in their upward travel by retainers 118.

In operation, downward pressure by the finger 40' on key 20' applies pressure on typewriter key 116 through shaft 115 against the force of spring 117. When pressure on key 20' is released, it is returned to its normal position by the force of spring 117.

First row key 41' is attached to a lever 119 which is journaled on shaft 114 and is formed to press upon first row key 120 of the typewriter supported in frame 16'. Keeper spring 121 is formed to coil around shaft 114 and press upon lever 119 and support member 109.

In operation pressure by finger 40' against key 41' causes it to rotate on shaft 114 against the pressure of spring 121, forcing key 120 downward to operate that key 120 of the typewriter.

In similar disposition, key 60' is attached to lever 125 which is journaled on shaft 113 to contact a third row key 126 of the typewriter supported in frame 16'. A spring 127 is coiled on shaft 113 with opposite ends pressing against lever 125 and member 107.

In operation, pressure by finger 40' against key 60' forces rotation against the pressure of spring 127. Rotation of lever 125 actuates key 126 causing key 126 to be actuated.

Fourth row key 71' is attached to a lever 128 which is journaled on shaft 112 and is formed to contact fourth row key 129 of the typewriter supported in frame 16'. A spring 130 is coiled about shaft 112 and formed to apply pressure at opposite ends to lever 128 and frame member 106.

In operation, upward pressure by finger 40' against key 71' rotates lever 128 about shaft 112 to depress key 129 and actuate key 129.

Space bar 81' is provided with one or more shafts 131 slidably supported in frame number 110 above and in contact with space bar 132 of the typewriter supported in frame 16'. Space bar 81' is held in normal position by coil spring 133 and retainer 134.

In operation downward pressure on space bar 81' forces space bar 132 downward actuating space bar 132.

Keyboard apparatus of the embodiment shown in FIG. 5 and 6 is a self-contained unit adapted to be inserted over, and in operation to form an auxiliary part of, a typewriter which contains the usual apparatus and construction features. With this separate keyboard unit, the typewriter can be converted to take advantage of the higher speeds and other features obtainable with this invention.

A particularly important feature of this invention is the disposition and construction of fourth row keys 71 and 71', which brings the operation of the fourth row keys of the typewriter within close proximity of the typist's fingers. This greatly reduces the reach and time loss in striking fourth row keys.

It is equally important to recognize that the purposes of this invention are accomplished without changing in any way the Standard American typewriter configuration. A major drawback in the application of improvements to the typewriter keyboard in the past has been their departure from the standard keyboard arrangement.

The term "typewriter" as used herein is intended to encompass the broad range of keyboard apparatus used to input information to word and letter typing machines, linotype machines, computer terminals, etc. where the fingers of a person's hands are used to contact keys.

It is herein understood that although the present invention has been specifically disclosed with the preferred embodiments and examples, modification and variations of these concepts herein disclosed may be resorted to by those skilled in the art. Such modifications and variations are considered to be within the scope of the invention and the appended claims.

What is claimed is:

1. A keyboard for a key actuated device including a plurality of keys constructed to be actuated by movement of the fingers of an operator downward, forward, backward, and upward against the keys, comprising at each finger position:

(a) a first key disposed among the plurality of keys and having a substantially horizontal contact surface and disposed for downward actuation;

(b) a second key disposed beside and at an angle with respect to the first key, and disposed for forward actuation;

(c) a third key disposed beside, at an angle, and oppositely facing with respect to the second key, and disposed for backward actuation; and (d) a fourth key disposed above the first key and disposed for upward actuation.

2. A keyboard apparatus, according to claim 1 wherein the keyboard is on a typewriter.

3. A keyboard apparatus, according to claim 2 wherein the typewriter is arranged with the Standard American keyboard of letters and characters.

4. A keyboard apparatus according to claim 1 wherein the keyboard apparatus is disposed in a separate frame attached to the key actuated device.

5. A keyboard according to claim 1, wherein the fourth key is disposed above the first and second keys.

6. A keyboard according to claim 1, wherein said key actuated device is a typewriter having the Standard American keyboard arrangement of keys.

7. A keyboard according to claim 1, wherein the fourth key is disposed at an angle relative to a contact surface of the second key.

8. A keyboard according to claim 7, wherein the contact surface of the second key is at right angles to a contact surface of the first key, a contact surface of the third key is at right angles to the contact surface of the first key, and a contact surface of the fourth key is at an angle with respect to the contact surface of the second key.

9. A keyboard apparatus according to claim 1 wherein the keys have adjustment means for positioning contact surfaces of the keys relative to a finger that is positioned for typing.

10. An attachment apparatus having a first keyboard, for attachment on a key actuated device having a second keyboard with designated home row keys and a frame, comprising:

(a) an attachment frame constructed to fit on the frame of the device to circumvent the second keyboard, (b) a plurality of attachment keys supported by the attachment frame at a position above the second keyboard of the device, (c) a first group of keys, in the plurality of attachment keys, supported to strike the home row keys of the device when operated by finger contact on the first group of keys, (d) a second attachment key disposed beside and at an angle with respect to each first group key, (e) a third attachment key disposed beside, at an angle, and oppositely facing with respect to each second key, and (f) a fourth attachment key disposed above each first group key.

* * * * *